US009805854B2

(12) United States Patent
Yeom et al.

(10) Patent No.: US 9,805,854 B2
(45) Date of Patent: Oct. 31, 2017

(54) INDUCTOR

(71) Applicant: LG INNOTEK CO., LTD., Seoul (KR)

(72) Inventors: Jai Hoon Yeom, Seoul (KR); Seok Bae, Seoul (KR); So Yeon Kim, Seoul (KR); Sang Won Lee, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

(21) Appl. No.: 14/962,145

(22) Filed: Dec. 8, 2015

(65) Prior Publication Data

US 2016/0172094 A1 Jun. 16, 2016

(30) Foreign Application Priority Data

Dec. 11, 2014 (KR) ..... 10-2014-0178696

(51) Int. Cl.

| | |
|---|---|
| ***H01F 17/04*** | (2006.01) |
| ***H01F 27/28*** | (2006.01) |
| ***H01F 27/24*** | (2006.01) |
| ***H01F 3/14*** | (2006.01) |
| ***H01F 27/38*** | (2006.01) |
| ***H01F 1/20*** | (2006.01) |
| *H01F 3/10* | (2006.01) |

(52) U.S. Cl.

CPC ..... *H01F 27/24* (2013.01); *H01F 1/20* (2013.01); *H01F 3/14* (2013.01); *H01F 27/2823* (2013.01); *H01F 27/38* (2013.01); *H01F 2003/106* (2013.01)

(58) Field of Classification Search

CPC ..... H01F 27/24; H01F 27/2823; H01F 27/38; H01F 27/255; H01F 1/20; H01F 3/14; H01F 3/08; H01F 2003/106

USPC ..... 336/212, 233, 170, 221, 220

See application file for complete search history.

(56) References Cited

U.S. PATENT DOCUMENTS

| | | | | |
|---|---|---|---|---|
| 5,656,983 | A | 8/1997 | Ito et al. | |
| 5,731,666 | A | 3/1998 | Folker et al. | |
| 5,748,013 | A * | 5/1998 | Beauclair | H01F 41/0246 252/62.54 |
| 6,980,077 | B1 | 12/2005 | Chandrasekaran et al. | |

(Continued)

FOREIGN PATENT DOCUMENTS

| | | | |
|---|---|---|---|
| EP | 1207540 | A1 | 5/2002 |
| EP | 2797087 | A1 | 10/2014 |

(Continued)

OTHER PUBLICATIONS

European search report for European Patent Application No. 15198706.2 corresponding to the above-referenced U.S. application.

*Primary Examiner* — Mangtin Lian

(74) *Attorney, Agent, or Firm* — LRK Patent Law Firm

(57) ABSTRACT

An inductor includes a first magnetic core around which a first coil is wound; a second magnetic core disposed to face the first magnetic core and having a second coil wound therearound; and a third magnetic core disposed between the first magnetic core and the second magnetic core, wherein the first magnetic core and the second magnetic core are formed of the same material having a soft magnetic powder, and the third magnetic core is formed of a material having a soft magnetic powder different from the first magnetic core and the second magnetic core.

15 Claims, 5 Drawing Sheets

(56) References Cited

U.S. PATENT DOCUMENTS

| | | | | |
|---|---|---|---|---|
| 9,224,530 | B2 * | 12/2015 | Kim | H01F 27/24 |
| 2002/0195973 | A1 | 12/2002 | Hu et al. | |
| 2003/0043006 | A1 | 3/2003 | Sum et al. | |
| 2010/0254168 | A1 | 10/2010 | Chandrasekaran | |
| 2013/0033351 | A1 | 2/2013 | Kim et al. | |
| 2016/0111203 | A1 | 4/2016 | Yamamoto | |
| 2016/0148746 | A1 * | 5/2016 | Shudarek | H01F 27/263 336/5 |

FOREIGN PATENT DOCUMENTS

| | | | |
|---|---|---|---|
| JP | 2014127637 | A | 7/2014 |
| WO | 2014/091589 | A1 | 6/2014 |

* cited by examiner

INDUCTOR

CROSS-REFERENCE TO RELATED APPLICATION

This application claims priority to and the benefit of Korean Patent Application No. 2014-0178696, filed on Dec. 11, 2014, the disclosure of which is incorporated herein by reference in its entirety.

BACKGROUND

1. Field of the Invention

The present invention relates to an inductor, and more particularly, to an inductor capable of being applied to a large current application such as solar power, wind power, and automobile industry.

2. Discussion of Related Art

Recently, electronic products have had various functions and high performances, and particularly, have tended to have been developed slim and light. The sizes and volumes of components mounted in the electronic products should be decreased to achieve the slim and light electronic products.

In particular, as semiconductor integrated circuit technology has developed, slim and light circuitry is able to be implemented, however, it is not easy to reduce volumes of inductors mounted inside the electronic products. Therefore, research and development to implement the slim and light inductors has been continuously conducted.

Meanwhile, since the power supply included in the electronic products needs to reduce harmonic frequencies and to improve an input power factor in commercial electricity, a power factor correction (PFC) converter, circuitry for improving the input power factor, has been widely used.

In addition, an interleaved PFC converter (or an interleaved boost converter) using two separate inductors has been applied to reduce a ripple of an input current (Iin) and to improve the efficiency of a PFC converter.

To this end, since air gaps are needed in magnetic paths in a core intermediate portion and core side surfaces to manufacture a conventional inductor, and a separate cutting process is necessarily required to form the air gaps, there are problems that manufacturing costs for processing increase, the volume of the inductor increases and management of the air gaps is difficult.

SUMMARY OF THE INVENTION

Embodiments of the present invention provide an inductor capable of enhancing a DC superposition characteristic without an increased volume, and improving efficiency by decreasing an amount of copper wire usage therethrough.

In addition, embodiments of the present invention also provide an inductor capable of preventing degradation of a characteristic due to increasing temperature of the inductor by minimizing core loss, and easily changing a structure thereof through selection of a core material.

According to an aspect of the present invention, an inductor includes a first magnetic core around which a first coil is wound; a second magnetic core disposed to face the first magnetic core and having a second coil wound therearound; and a third magnetic core disposed between the first magnetic core and the second magnetic core, wherein the first magnetic core and the second magnetic core are formed of the same material having a soft magnetic powder, and the third magnetic core is formed of a material having a soft magnetic powder different from the first magnetic core and the second magnetic core.

The third magnetic core may be formed of a soft magnetic powder having a greater saturation magnetic flux density than those of the first magnetic core and the second magnetic core.

The third magnetic core may be formed of a soft magnetic powder having a smaller core loss than those of the first magnetic core and the second magnetic core.

The first magnetic core, the second magnetic core and the third magnetic core may be formed of at least one of a sendust alloy powder, a high flux powder, an MPP powder, and a silicon steel (Fe—Si).

The first magnetic core and the second magnetic core each may include a longitudinal portion in a bar shape and extending portions vertically extending from both ends of the longitudinal portion.

The first magnetic core and the second magnetic core may be disposed so that the extending portions face each other.

The third magnetic core may be disposed between facing surfaces of the extending portions of the first magnetic core and the second magnetic core.

The third magnetic core may be in contact with the extending portions of the first magnetic core and the second magnetic core.

The first coil and the second coil may be wound around the extending portions.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
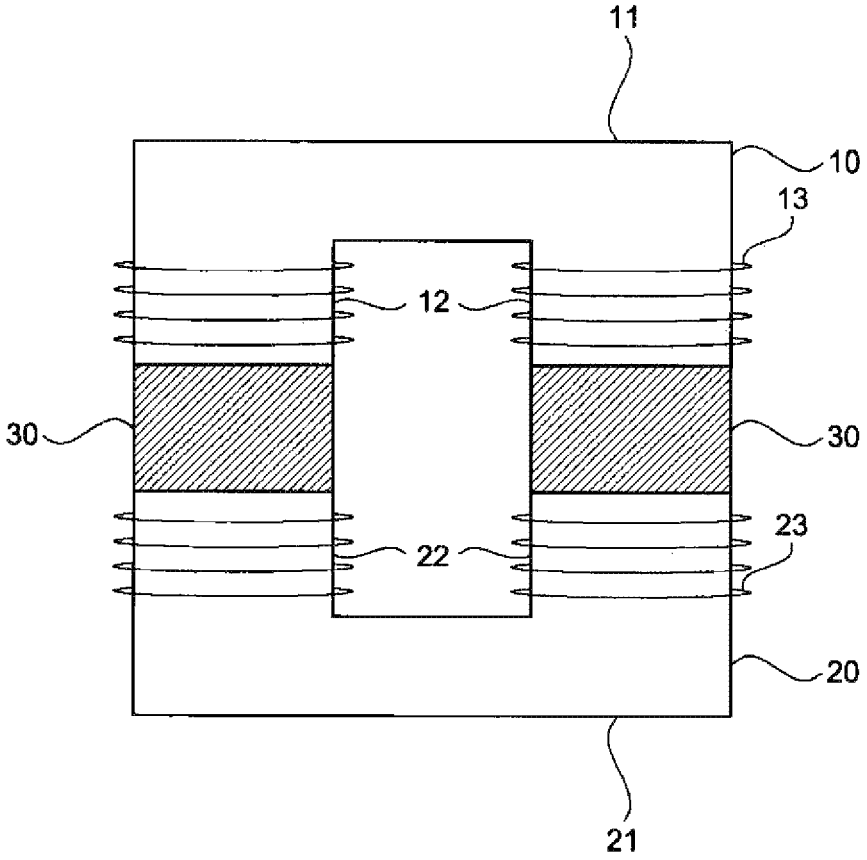
FIG. 1 is a view illustrating an inductor according to one embodiment of the present invention.

While the invention is susceptible to various modifications and alternative embodiments, specific embodiments thereof are shown by way of example in the drawings and will be described. However, it should be understood that there is no intention to limit the invention to the particular embodiments disclosed, but on the contrary, the invention is to cover all modifications, equivalents, and alternatives falling within the spirit and scope of the invention.

It will be understood that, although the terms including ordinal numbers such as "first," "second," etc. may be used herein to describe various elements, these elements are not limited by these terms. These terms are only used to distinguish one element from another. For example, a second element could be termed a first element without departing from the teachings of the present concept, and similarly a first element could be also termed a second element. The term "and/or" includes any and all combination of one or more of the associated listed items.

It will be understood that when an element or layer is referred to as being "on." "connected to," or "coupled with" another element or layer, it can be directly on, connected, or coupled to the other element or layer or intervening elements or layers may be present. In contrast, when an element is referred to as being "directly on," "directly connected to," or "directly coupled with" another element or layer, there are no intervening elements or layers present.

The terminology used herein is for the purpose of describing particular embodiments only and is not intended to be limiting of the present concept. As used herein, the singular forms "a," "an," and "the," are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms including technical and scientific terms used herein have the same meaning as commonly understood by one of ordinary skill in the art to which this concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, embodiments of the present invention will be described in detail with reference to the accompanying drawings, and regardless of numbers in the drawings, the same or corresponding elements will be assigned with the same numbers and overlapping descriptions will be omitted.

Figure 2:
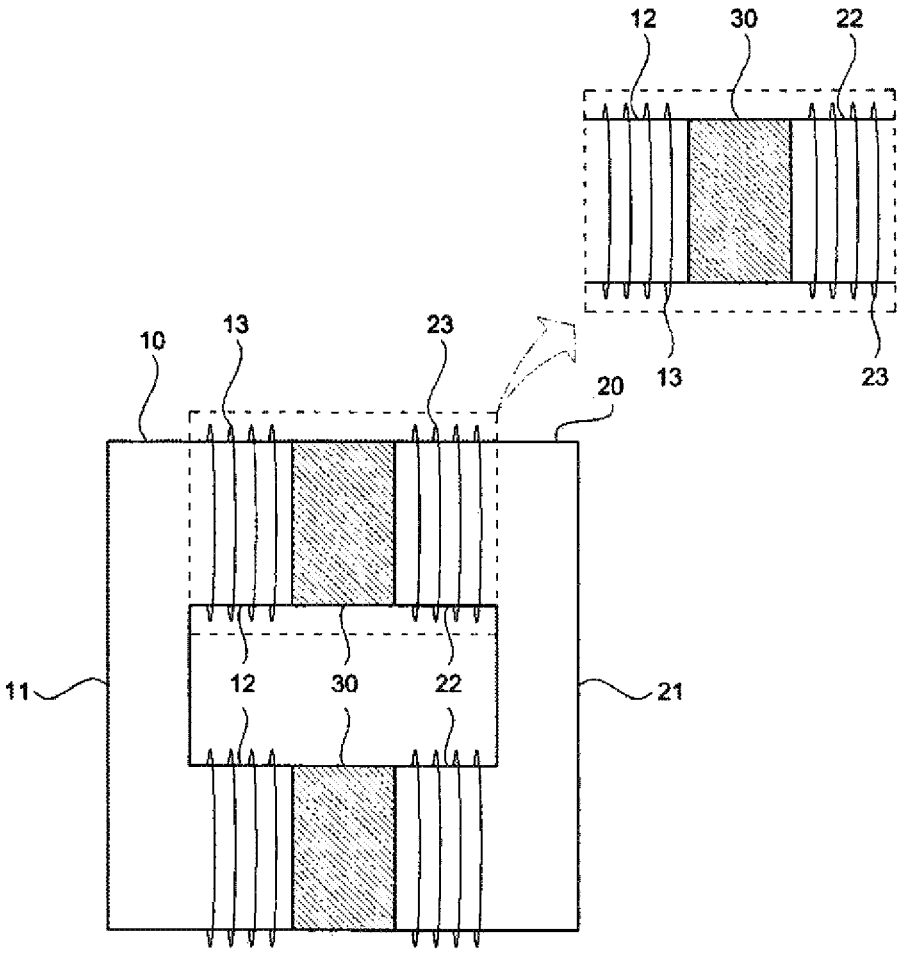
FIG. 2 is a view for describing the inductor according to one embodiment of the present invention.

FIG. 1 is a view illustrating an inductor according to one embodiment of the present invention. FIG. 2 is a partially enlarged view of the inductor according to one embodiment of the present invention.

Referring to FIGS. 1 and 2, an inductor according to one embodiment of the present invention may include a first magnetic core 10 around which a first coil 13 is wound, a second magnetic core 20 disposed to face the first magnetic core 10 and having a second coil 23 wound therearound, and a third magnetic core 30 disposed between the first magnetic core 10 and the second magnetic core 20.

The first magnetic core 10 may include a longitudinal portion 11 in a bar shape and extending portions 12 vertically extending from both ends of the longitudinal portion 11. The first magnetic core 10 may have a ⊏ shape. The first magnetic core 10 may be formed by processing a metal alloy having a soft magnetic characteristic into a powder form, coating the powder form with a ceramic or a polymeric binder, insulating the coated powder form and processing the insulated powder form through a high pressure forming process. The first coil 13 may be wound around the extending portions 12 of the first magnetic core.

The second magnetic core 20 may include a longitudinal portion 21 in a bar shape and extending portions 22 vertically extending from both ends of the longitudinal portion 21. The second magnetic core 20 may have a ⊏ shape. The second magnetic core 20 may be formed by processing a metal alloy having a soft magnetic characteristic into a powder form, coating the powder form with a ceramic or a polymeric binder, insulating the coated powder form and processing the insulated powder form through a high pressure forming process. The second coil 23 may be wound around the extending portions 22 of the second magnetic core.

The first magnetic core 10 and the second magnetic core 20 may be disposed so that the extending portions 12 and the extending portions 22 face each other.

The third magnetic core 30 may be disposed between facing surfaces of the extending portions 12 of the first magnetic core 10 and the extending portions 22 of the second magnetic core 20. The third magnetic core 30 may be formed to correspond to cross-sectional shapes of the extending portions 12 of the first magnetic core 10 and the extending portions 22 of the second magnetic core 20. In one embodiment of the present invention, the third magnetic core 30 may have a hexahedral shape according to the cross-sectional shapes of the extending portions 12 of the first magnetic core 10 and the extending portions 22 of the second magnetic core 20. The third magnetic core 30 may be formed by processing a metal alloy having a soft magnetic characteristic into a powder form, coating the powder form with a ceramic or a polymeric binder, insulating the coated powder form and processing the insulated powder form through a high pressure forming process.

The third magnetic core 30 may be disposed between the first magnetic core 10 and the second magnetic core 20 according to the extending portions 12 and the extending portions 22 facing each other. That is, the third magnetic core 30 may be formed to have the same width as the extending portions 12 of the first magnetic core 10 and the extending portions 22 of the second magnetic core 20 within a certain error range.

The third magnetic core 30 may be formed based on a distance between the first magnetic core 10 and the second magnetic core 20. That is, third magnetic core 30 may be formed to have the same length as the distance between the first magnetic core 10 and the second magnetic core 20 within a certain error range.

The first magnetic core 10 and the second magnetic core 20 may be formed of the same material having a soft magnetic powder. The third magnetic core 30 may be formed of a material having a soft magnetic powder different from the first magnetic core 10 and the second magnetic core 20. Here, the criteria by which the materials of the first to third magnetic cores are selected may be considered based on a DC superposition characteristic (DC-bias), core loss, an inductor size, a unit cost, and the like.

For example, the third magnetic core 30 may be formed of a soft magnetic powder having a greater saturation magnetic flux density than those of the first magnetic core 10 and the second magnetic core 20. When the third magnetic core 30 is formed of a soft magnetic powder having a high saturation magnetic flux density, a DC superposition characteristic may be enhanced.

For example, the third magnetic core 30 may be formed of a soft magnetic powder having a smaller saturation magnetic flux density than those of the first magnetic core 10 and the second magnetic core 20. When the third magnetic core 30 is formed of a soft magnetic powder having a low saturation magnetic flux density, core loss occurring due to the magnetic cores having the same permeability may be prevented.

Referring to Table 1 below, Comparative Examples 1 to 3 are characteristic values measured when the first magnetic core 10, the second magnetic core 20, and the third magnetic core 30 are formed of the same material having a soft magnetic powder. Examples 1 to 3 are characteristic values measured when the third magnetic core 30 are formed of a material having a soft magnetic powder different from the first magnetic core 10 and the second magnetic core 20.

TABLE 1

| | BLOCK CONDITION | | CHARACTERISTIC COMPARISON | | |
|---|---|---|---|---|---|
| NUMBERS | 1 | 2 | DC-Bias (%) | Core Loss (mW/cm$^3$) | Size |
| Comparative Example 1 | Fe—Si | Fe—Si | 82 | 680 | 100 |
| Comparative Example 2 | Sendust | Sendust | 55 | 320 | 130 |
| Comparative Example 3 | HF | HF | 82 | 260 | 100 |
| Example 1 | Sendust | Fe—Si | 70 | 380 | 120 |
| Example 2 | HF | Fe—Si | 82 | 350 | 100 |
| Example 3 | Amorphous | Fe—Si | 78 | 330 | 110 |

When compared with Comparative Example 1, Example 1 has a slightly decreased value in DC-bias but a greatly decreased value in core loss compared with an inductor which is only composed of silicon steel.

When compared with Comparative Example 2, Example 1 has a slightly increased value in core loss but an enhanced DC-bias with a greatly increased value compared with an inductor which is only composed of sendust.

When compared with Comparative Example 1, Example 2 has a greatly decreased value in core loss compared with an inductor which is only composed of silicon steel.

When compared with Comparative Example 3, Example 2 has a slightly increased value in core loss but the same DC-bias as Comparative Example 3, while greatly decreasing manufacturing costs.

When compared with Comparative Example 1, Example 3 has a slightly decreased value in DC bias but a greatly decreased value in core loss.

As determined in Table 1, when the third magnetic core 30 may be formed of a material having a soft magnetic powder different from a soft magnetic powder forming the first magnetic core 10 and the second magnetic core 20, great improvement in the desired characteristic may be obtained.

Figure 3:
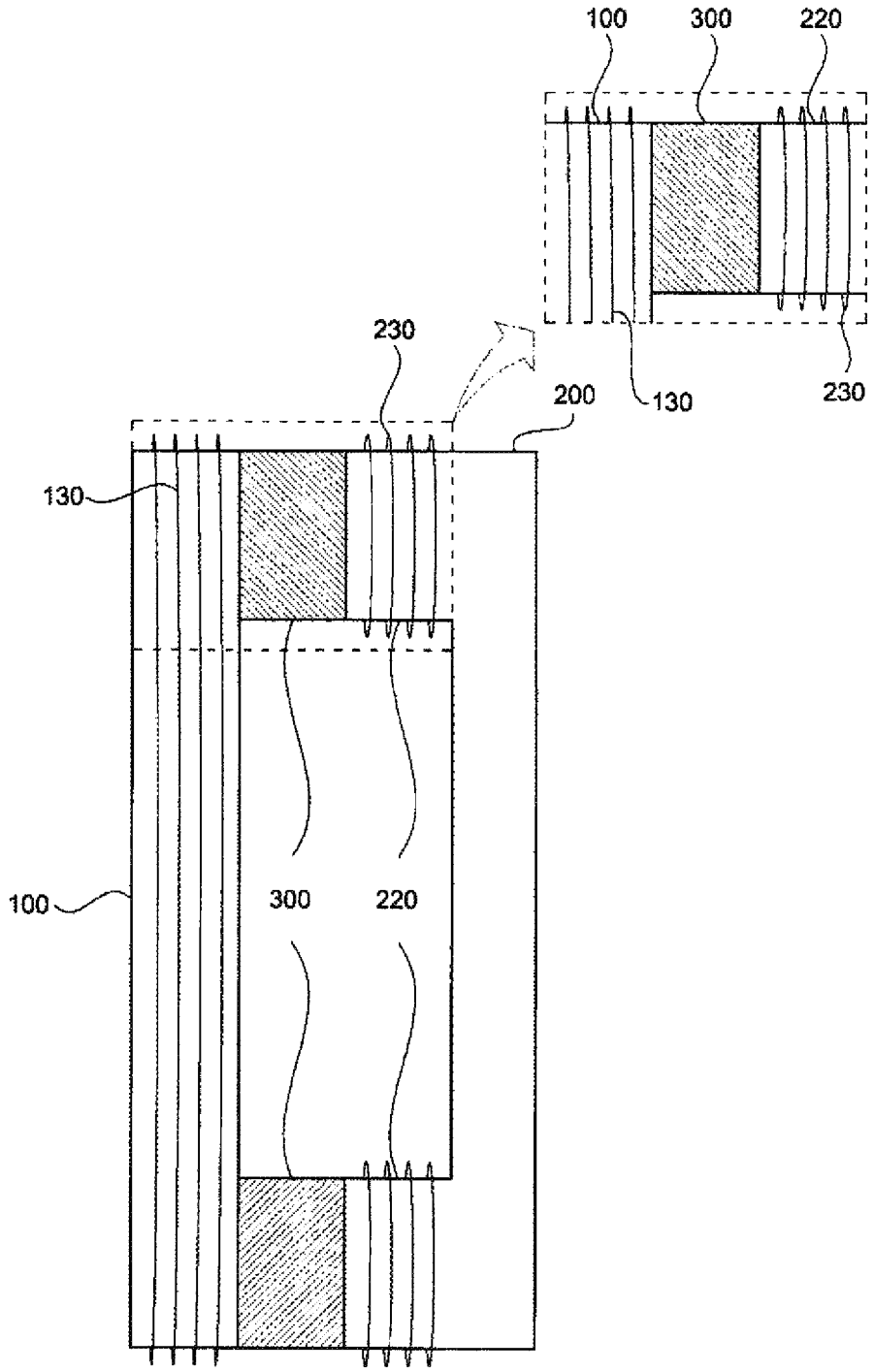
FIG. 3 is a view for describing an inductor according to another embodiment of the present invention.

FIG. 3 is a view illustrating an inductor according to another embodiment of the present invention.

Referring to FIG. 3, an inductor according to an embodiment of the present invention may include a first magnetic core 100 around which a first coil 130 is wound, a second magnetic core 200 disposed to face the first magnetic core 100 and having a second coil 230 wound therearound, and a third magnetic core 300 disposed between the first magnetic core 100 and the second magnetic core 200.

The first magnetic core 100 may have a bar shape. The first magnetic core 100 may be formed by processing a metal alloy having a soft magnetic characteristic into a powder form, coating the powder form with a ceramic or a polymeric binder, insulating the coated powder form and processing the insulated powder form through a high pressure forming process. The first coil 130 may be wound around the first magnetic core 100.

The second magnetic core 200 may include a longitudinal portion 210 in a bar shape and extending portions 220 vertically extending from both ends of the longitudinal portion 210. The second magnetic core 200 may have a ⊏ shape. The second magnetic core 200 may be formed by processing a metal alloy having a soft magnetic characteristic into a powder form, coating the powder form with a ceramic or a polymeric binder, insulating the coated powder form and processing the insulated powder form through a high pressure forming process. The second coil 230 may be wound around the extending portions 220 of the second magnetic core.

The first magnetic core 100 and the extending portions 220 of the second magnetic core 200 may be disposed to face each other.

The third magnetic core 300 may be disposed between the first magnetic core 100 and the extending portion 220 of the second magnetic core 200. The third magnetic core 300 may be formed based on the cross-sectional shapes of the first magnetic core 100 and the extending portions 220 of the second magnetic core 200. In an embodiment of the present invention, the third magnetic core 300 may have a hexahedral shape according to the cross-sectional shapes of the first magnetic core 100 and the extending portions 220 of the second magnetic core 200. The third magnetic core 300 may be formed by processing a metal alloy having a soft magnetic characteristic into a powder form, coating the powder form with a ceramic or a polymeric binder, insulating the coated powder form and processing the insulated powder form through a high pressure forming process.

The third magnetic core 300 may be disposed based on the first magnetic core 100 and the extending portion 220 of the second magnetic core 200. That is, the third magnetic core 300 may be formed to have the same width as the extending portion 220 of the second magnetic core 20 within a certain error range.

The third magnetic core 300 may be formed based on a distance between the first magnetic core 100 and the extending portions 220 of the second magnetic core 200. That is, the third magnetic core 300 may be formed to have the same length as the distance between the first magnetic core 100 and the extending portion 220 of the second magnetic core 200 within a certain error range.

The first magnetic core 100 and the second magnetic core 200 may be formed of the same material having a soft magnetic powder. The third magnetic core 300 may be formed of a material having a soft magnetic powder different from the first magnetic core 100 and the second magnetic core 200. Here, the criteria by which the materials of the first to third magnetic core are selected may be considered based on a DC superposition characteristic (DC-bias), core loss, a size of an inductor, a unit cost, and the like.

For example, the third magnetic core 300 may be formed of a soft magnetic powder having a greater saturation magnetic flux density than those of the first magnetic core 100 and the second magnetic core 200. When the third magnetic core 300 is formed of a soft magnetic powder having a high saturation magnetic flux density, a DC superposition characteristic may be enhanced.

For example, the third magnetic core 300 may be formed of a soft magnetic powder having a smaller saturation magnetic flux density than those of the first magnetic core 100 and the second magnetic core 200. When the third magnetic core 300 is formed of a soft magnetic powder having a low saturation magnetic flux density, core loss occurring due to the magnetic cores having the same permeability may be prevented.

Figure 4:
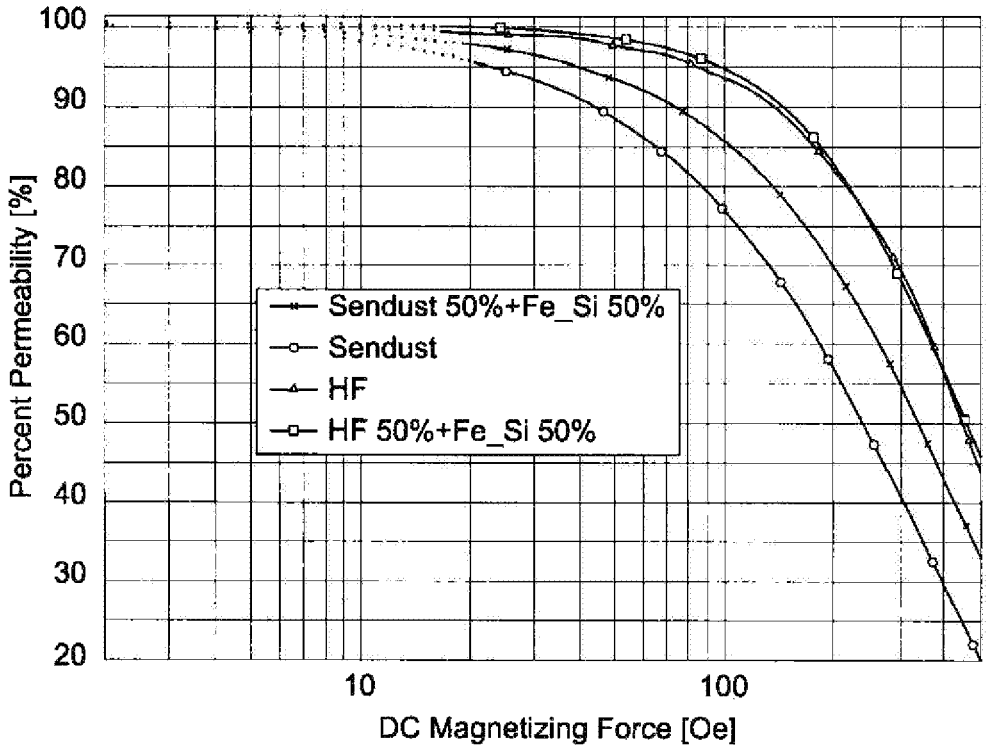
FIG. 4 is a graph illustrating a characteristic of the inductor according to one embodiment of the present invention.

FIG. 4 is a graph illustrating a characteristic of an inductor according to one embodiment of the present invention.

Referring to FIG. 4, it can be seen that percent permeability of an inductor composed of a 50% sendust and 50% silicon steel mixture is enhanced when compared with an inductor formed with sendust.

Further, it can be seen that percent permeability of an inductor composed of a 50% high flux powder and 50% silicon steel mixture is enhanced when compared with an inductor formed with a high flux powder.

Figure 5:
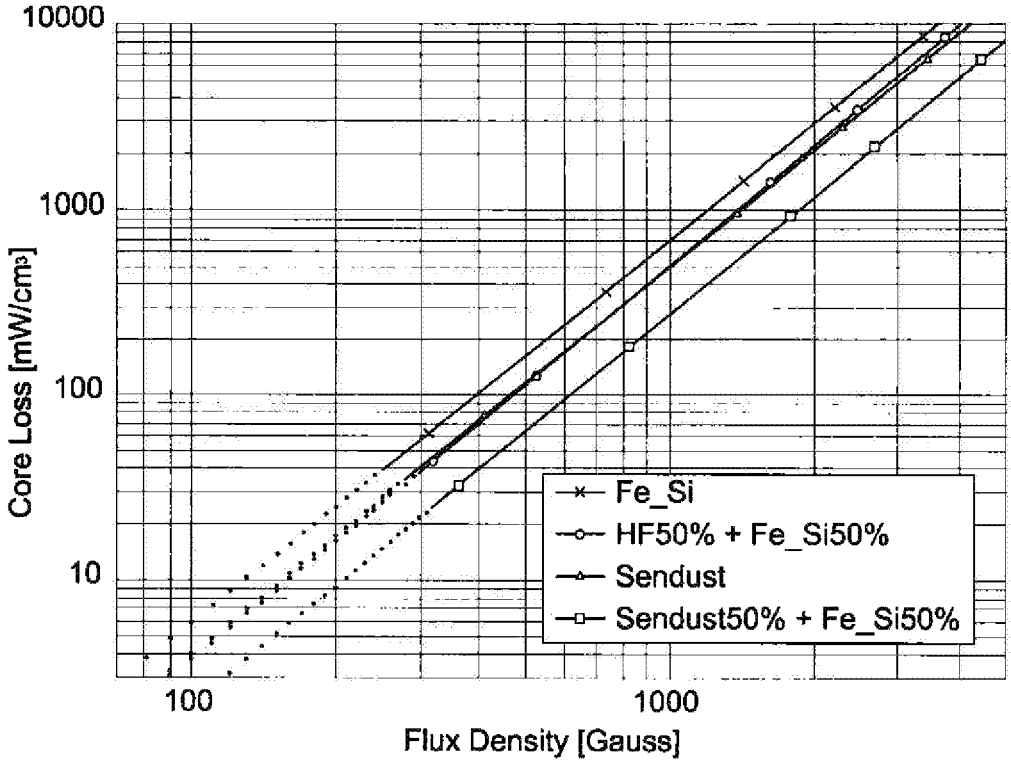
FIG. 5 is a graph illustrating a characteristic of the inductor according to one embodiment of the present invention.

FIG. 5 is a graph illustrating a characteristic of an inductor according to one embodiment of the present invention.

Referring to FIG. 5, it can be seen that core loss of an inductor composed of a 50% high flux powder and 50% silicon steel mixture is decreased when compared with an inductor formed with silicon steel.

Further, it can be seen that core loss of an inductor composed of a 50% sendust and 50% silicon steel mixture is decreased when compared with an inductor formed with sendust An inductor according to the present invention can have an enhanced DC superposition characteristic without an increased volume, thereby, efficiency can be improved by decreasing an amount of copper wire usage, and degradation of a characteristic due to increasing temperature thereof can be prevented, due to minimizing core loss.

Although exemplary embodiments of the present invention have been referenced and described above, it will be understood that it is possible for those of ordinary skill in the art to implement modifications and variations on the present invention without departing from the concept and scope of the present invention listed in the following appended claims.

What is claimed is:

1. An inductor comprising:

a first magnetic core around which a first coil is wound;

a second magnetic core disposed to face the first magnetic core and having a second coil wound therearound; and a third magnetic core disposed between the first magnetic core and the second magnetic core, wherein the first magnetic core and the second magnetic, core are formed of silicon steel (Fe—Si), and the third magnetic core is formed of sendust alloy, wherein a DC bias of the inductor is 70-78%, and a core loss of the inductor is 330-380 $mW/cm^3$, wherein the first magnetic core comprises a longitudinal portion, and a first extending portion and a second extending portion which are vertically extended from both ends of the longitudinal portion of the first magnetic core, wherein the second magnetic core comprises a longitudinal portion, and a third extending portion and a fourth extending portion which are vertically extended from both ends of the longitudinal portion of the second magnetic core, wherein the third magnetic core comprises a first part and a second part, wherein the first part is disposed between the first extending portion and the third extending portion, wherein the second part spaced apart from the first part is disposed between the second extending portion and the fourth extending portion, wherein the first coil is wound around the first and second extending portions of the first magnetic core, and the second coil is wound around the third and fourth extending portions of the second magnetic core, and wherein the inductor is composed of a 50% sendust and 50% silicon steel mixture.

2. The inductor of claim 1, wherein the third magnetic core is formed of a soft magnetic powder having a greater saturation magnetic flux density than those of the first magnetic core and the second magnetic core.

3. The inductor of claim 1, wherein the third magnetic core is formed of a soft magnetic powder having a smaller core loss than those of the first magnetic core and the second magnetic core.

4. The inductor of claim 1, wherein the first magnetic core and the second magnetic core each include the longitudinal portion in a bar shape and the extending portions vertically extending from both ends of the longitudinal portion.

5. The inductor of claim 4, wherein the first magnetic core and the second magnetic core are disposed so that the extending portions face each other.

6. The inductor of claim 5, wherein the third magnetic core is disposed between facing surfaces of the extending portions of the first magnetic core and the second magnetic core.

7. The inductor of claim 6, wherein the third magnetic core is in contact with the extending portions of the first magnetic core and the second magnetic core.

8. The inductor of claim 5, wherein the first coil and the second coil are wound around the extending portions.

9. The inductor of claim 6, wherein the third magnetic core has the same cross-sectional shape as a cross-sectional shape facing the extending portions of the first magnetic core and the second magnetic core.

10. The inductor of claim 9, wherein the third magnetic core has the same cross-sectional area as a cross-sectional area facing the extending portions of the first magnetic core and the second magnetic core within a certain error range.

11. The inductor of claim 6, wherein the third magnetic core has the same cross-sectional shape as a cross-sectional shape facing the extending portions of the second magnetic core.

12. The inductor of claim 9, wherein the third magnetic core has the same cross-sectional area as a cross-sectional area facing the extending portions of the second magnetic core within, a certain error range.

13. The inductor of claim 1, wherein the first magnetic core has a bar shape and the second magnetic core includes the longitudinal portion in a bar shape and the extending portions vertically extending from both ends of the longitudinal portion.

14. The inductor of claim 13, wherein the first magnetic core are disposed to face the extending portions of the second magnetic core.

15. The inductor of claim 1, wherein the longitudinal portion of the first magnetic core is spaced apart from the first coil, and the longitudinal portion of the second magnetic core is spaced apart from the second coil.

* * * * *